US006883498B2

(12) United States Patent
Braun et al.

(10) Patent No.: US 6,883,498 B2
(45) Date of Patent: Apr. 26, 2005

(54) PRESSURE BOOSTER FOR A FUEL INJECTION SYSTEM

(75) Inventors: Wolfgang Braun, Ditzingen (DE); Bernd Mahr, Plochingen (DE); Martin Kropp, Tamm (DE); Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/477,102

(22) PCT Filed: May 10, 2002

(86) PCT No.: PCT/DE02/01701

§ 371 (c)(1),
(2), (4) Date: Jun. 10, 2004

(87) PCT Pub. No.: WO02/092999

PCT Pub. Date: Nov. 21, 2002

(65) Prior Publication Data

US 2004/0206335 A1 Oct. 21, 2004

(30) Foreign Application Priority Data

May 11, 2001 (DE) ..... 101 24 207

(51) Int. Cl.[7] ..... F02M 7/00
(52) U.S. Cl. ..... 123/446; 123/467; 239/88
(58) Field of Search ..... 123/446, 477, 123/467, 478; 239/88–92

(56) References Cited

U.S. PATENT DOCUMENTS

| | | | | |
|---|---|---|---|---|
| 4,069,800 A | | 1/1978 | Kanda et al. | |
| 4,372,272 A | * | 2/1983 | Walter et al. | 123/467 |
| 4,485,789 A | * | 12/1984 | Walter et al. | 123/467 |

FOREIGN PATENT DOCUMENTS

| | | |
|---|---|---|
| DE | 31 02 697 A1 | 10/1982 |
| DE | 195 31 870 A1 | 3/1997 |
| DE | 199 10 970 A1 | 9/2000 |
| DE | 199 39 422 A1 | 3/2001 |
| EP | 0 691 471 A1 | 1/1996 |

* cited by examiner

*Primary Examiner*—Mahmoud Gimie
(74) *Attorney, Agent, or Firm*—Ronald E. Greigg

(57) ABSTRACT

A pressure booster of a fuel injection system includes a displaceable piston unit (30*a*, 31*a*), which on one end can be subjected to pressure via a pressure booster chamber on the low-pressure side and on the other end has a pressure booster chamber on the high-pressure side for fuel compression. The piston unit has a further piston cross section, which is reduced compared to the first piston cross section provided for imposing pressure, for embodying a differential chamber that is connectable to a leak fuel line. At least one control conduit connects the pressure booster chamber on the low-pressure side to the differential chamber, whose opening is closed or opened as a function of the motion of at least parts of the piston unit.

15 Claims, 5 Drawing Sheets

PRESSURE BOOSTER FOR A FUEL INJECTION SYSTEM

CROSS-REFERENCE TO RELATED APPLICATIONS

This application is a 35 USC 371 application of PCT/DE 02/01701 filed on May 10, 2002.

BACKGROUND OF THE INVENTION

1. Field of the Invention

The invention relates to an improved pressure booster of a fuel injection system.

2. Description of the Prior Art

For the sake of better comprehension of the specification and claims, some terms will now be defined: The fuel injection system of the invention can be embodied as either stroke-controlled or pressure-controlled. Within the context of the invention, the term stroke-controlled fuel injection system is understood to mean that the opening and closing of the injection opening is effected with the aid of a displaceable nozzle needle as a result of the hydraulic cooperation of the fuel pressures in a nozzle chamber and in a control chamber. A pressure reduction inside the control chamber causes a stroke of the nozzle needle. Alternatively, the deflection of the nozzle needle can be effected by a final control element (actuator). In a pressure-controlled fuel injection system according to the invention, the nozzle needle is moved by the fuel pressure prevailing in the nozzle chamber of an injector, counter to the action of a closing force (spring), so that the injection opening is uncovered for an injection of the fuel out of the nozzle chamber into the cylinder. The pressure at which fuel emerges from the nozzle chamber into a cylinder of an internal combustion engine is called the injection pressure, while the term system pressure is understood to be the pressure at which fuel is available or kept on hand inside the fuel injection system. Fuel metering means furnishing a defined fuel quantity for injection. Leak fuel is understood to be a quantity of fuel that occurs in operation of the fuel injection system (such as reference leakage) and is not used for injection and is returned to the fuel tank. The pressure level of this leak fuel can have a standing pressure, and the fuel is then depressurized to the pressure level of the fuel tank.

In a fuel injection system in accordance with the teaching of German Patent Disclosure DE 199 39 428 A1, the entire high-pressure chamber in the injector and in the pressure booster must be depressurized upon the restoration of the piston of the pressure booster, resulting in high depressurization losses.

In a circuit in accordance with the teaching of German Patent Disclosure DE 199 10 970 A1, an additional control quantity occurs during the triggering of the pressure booster. This control quantity flows from the high-pressure line via a throttle and the differential chamber of the pressure booster into the leak fuel. This throttle should be designed with a small size, to reduce leakage losses. For easier, faster restoration of the piston of the pressure booster, conversely, a larger design is desirable, so that upon the restoration, excessive forces need not be overcome. In the installation space of the injector, it is not possible to achieve means for overcoming the forces that counteract the restoration, when the throttles are small. This slows down the restoration, which can sometimes not be completed before the next injection.

SUMMARY OF THE INVENTION

To minimize the aforementioned problems, a fuel injection system according to the invention is proposed in which, on the one hand, the force that must be employed to restore the piston when there is only one control conduit in the piston is reduced. On the other, the throttle in the permanent control conduit can be designed to be small, to avoid leakage losses upon activation of the pressure booster. Upon restoration after a piston stroke has been completed, the requisite restoring force is reduced by means of an additional control conduit.

In one embodiment of the invention, the control conduit is opened by a relative motion of two pistons upon restoration. In the compression stroke, the additional control conduit is closed, so that the leakage losses can be reduced.

In another embodiment, the restoration force through the control conduit after a long piston stroke (>h) has been effected is facilitated by the opened control conduit.

To further optimize the restoration performance, a plurality of additional control conduits can also be employed.

BRIEF DESCRIPTION OF THE DRAWINGS

Three exemplary embodiments of the invention are described more fully herein below, in conjunction with the drawings, in which.

DESCRIPTION OF THE PREFERRED EMBODIMENTS

Figure 1:
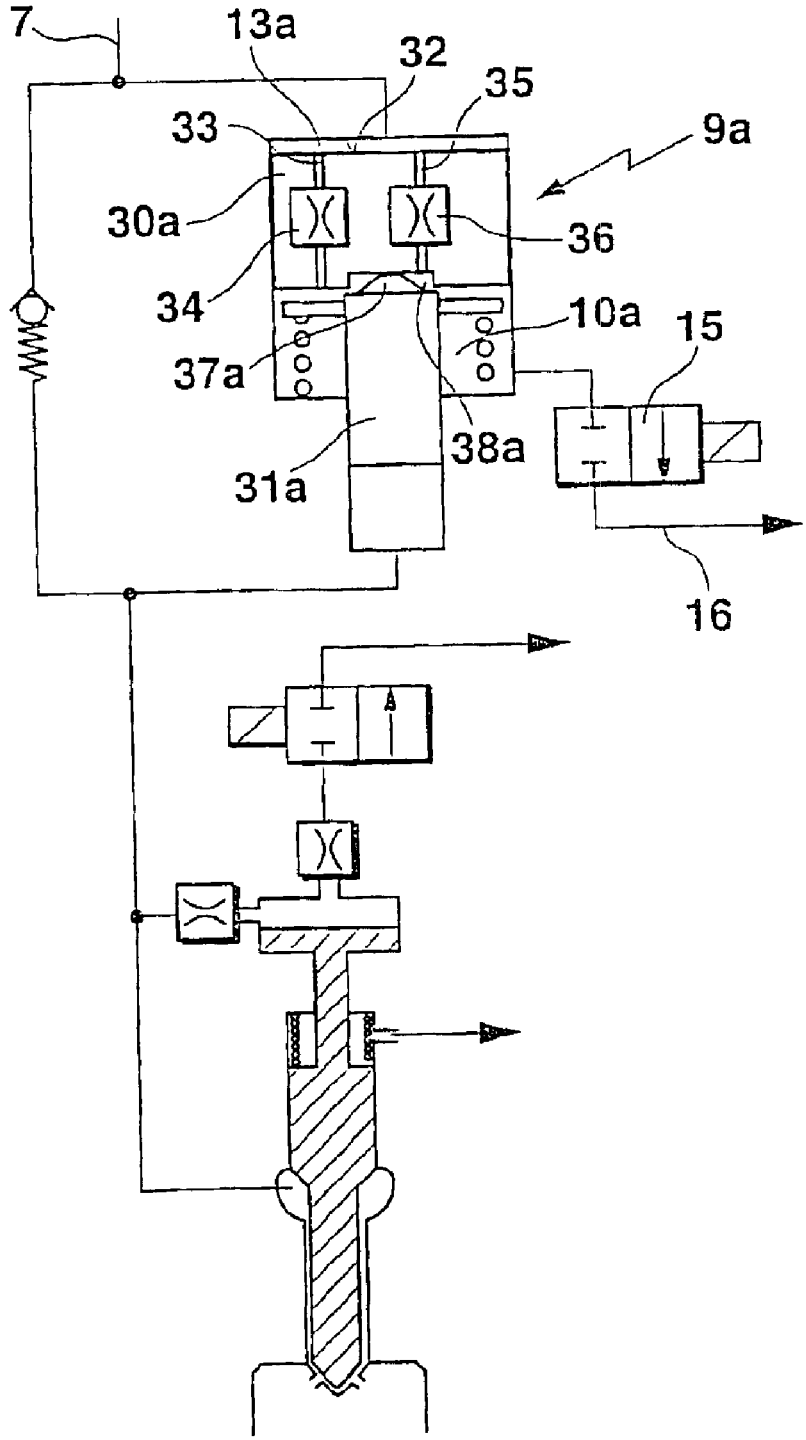
FIG. 1, schematically illustrates a first pressure booster of a fuel injection system according to the invention.
Figure 4:
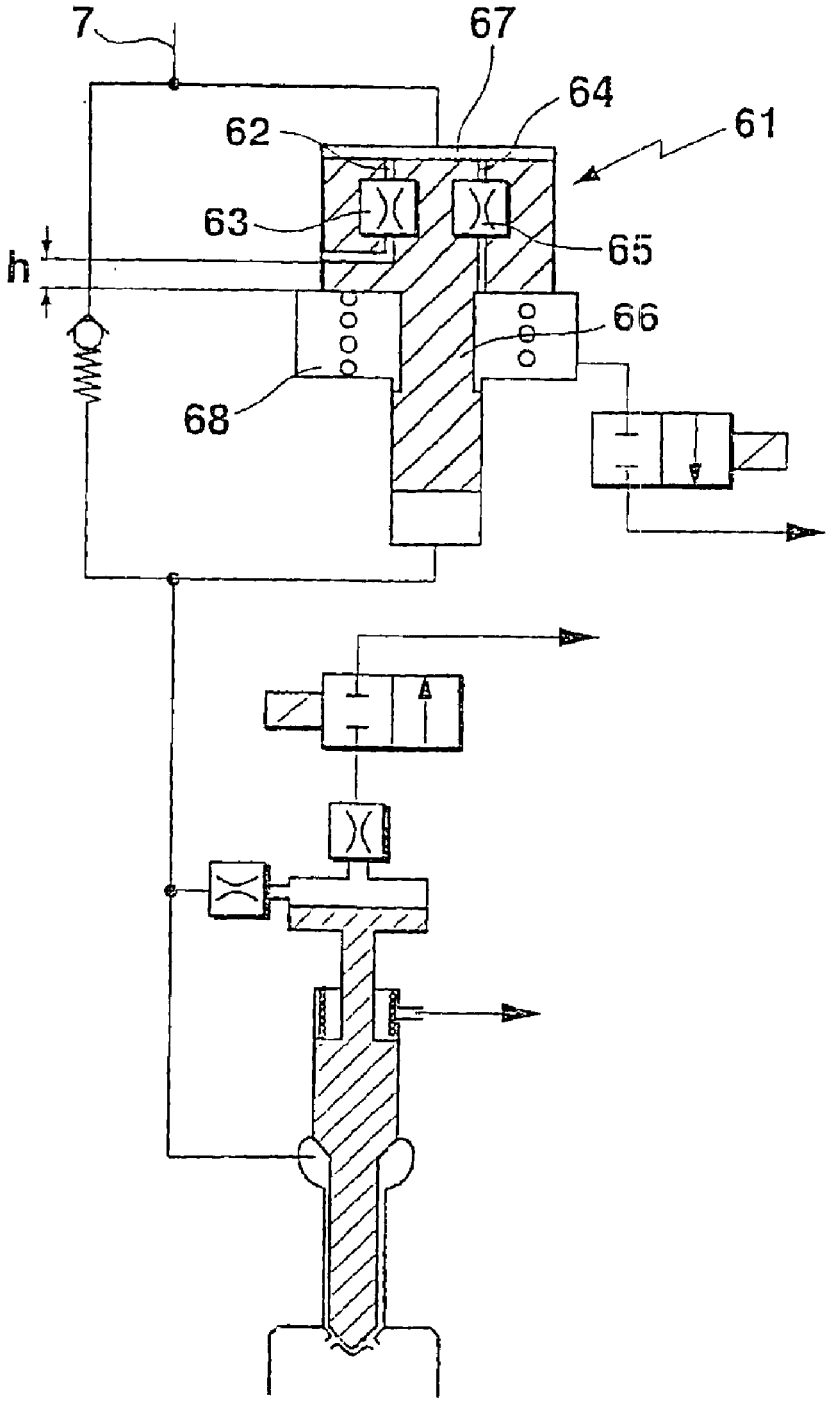
FIG. 4, a fourth pressure booster of a fuel injection.

It can be seen from FIG. 1 that the pressure booster 9*a* of a first exemplary embodiment, in a refinement of a prior art in accordance with FIG. 4, has a first piston 30*a* and second piston 31*a* (two-part piston embodiment). A persistent force transfer takes place from the first piston 30*a* to the second piston 31*a*, when a piston face 32 is subjected to pressure upon activation of the pressure booster 9*a* (opened valve 15). During the activation of the pressure booster 9*a*, a control quantity of fuel flows via a first control conduit 33, having a first throttle 34, and via a differential chamber 10*a* into the leak fuel line 16. In the first piston 30*a*, an additional, second control conduit 35 is embodied, which contains a second throttle 36. Upon activation of the pressure booster 9*a* (opened valve 15), the cup spring 37*a* is compressed by the force transfer from the first piston 30*a* to the second piston 31*a*, and a gap 38*a* between the pistons 30*a* and 31*a* is closed, as a result of which the second control conduit 35 is closed.

With the pressure booster 9*a* switched off (closed valve 15) and a reduced force transfer between the pistons 30*a* and 13*a*, the gap 38*a* is uncovered, so that via the second control conduit 35 as well, fuel can flow out of the pressure booster chamber 13*a* on the low-pressure side into the differential chamber 10*a*. On the one hand, the force which would have to be employed to restore the pistons 30*a* and 31*a* if there were only one control conduit in the piston 30*a* is reduced. On the other, the throttle 34 can be designed to be small, to reduce leakage losses when the pressure booster 9*a* is activated.

Figure 2:
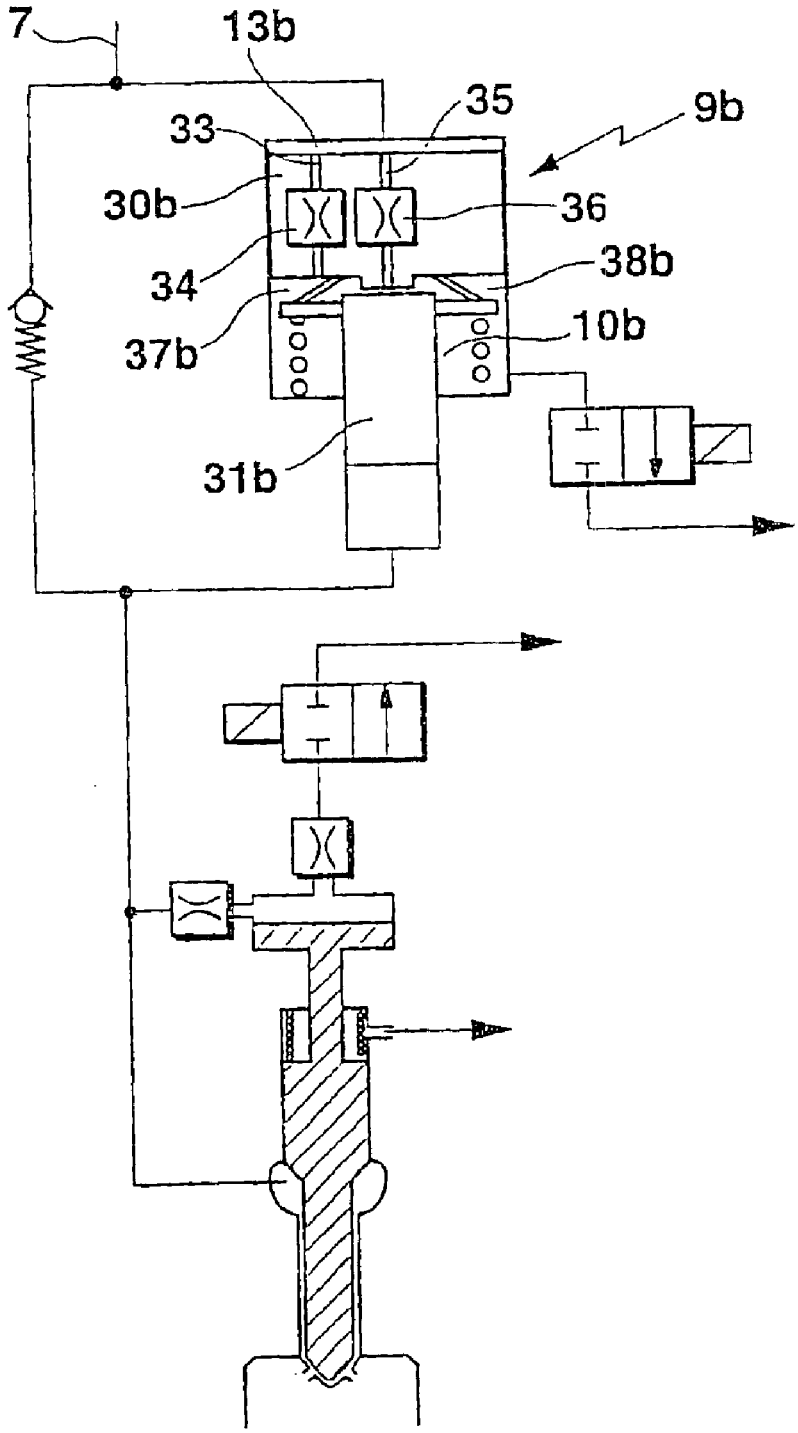
FIG. 2, a second pressure booster of a fuel injection system.

FIG. 2 pertains to an arrangement similar to FIG. 1. Structural parts that are identical or similar are identified by the same or similar reference numerals (9*a*≈9*b*, 10*a*≈10*b*,

13*a*≈13*b*, 30*a*≈30*b*, 31*a*≈31*b*, 37*a*≈37*b*, 38*a*≈38*b*). Differences in the arrangement come about as a result of the cup spring 37*b*, the sealing gap 38*b*, and the contact faces of the pistons 30*b*, 31*b*.

Figure 3:
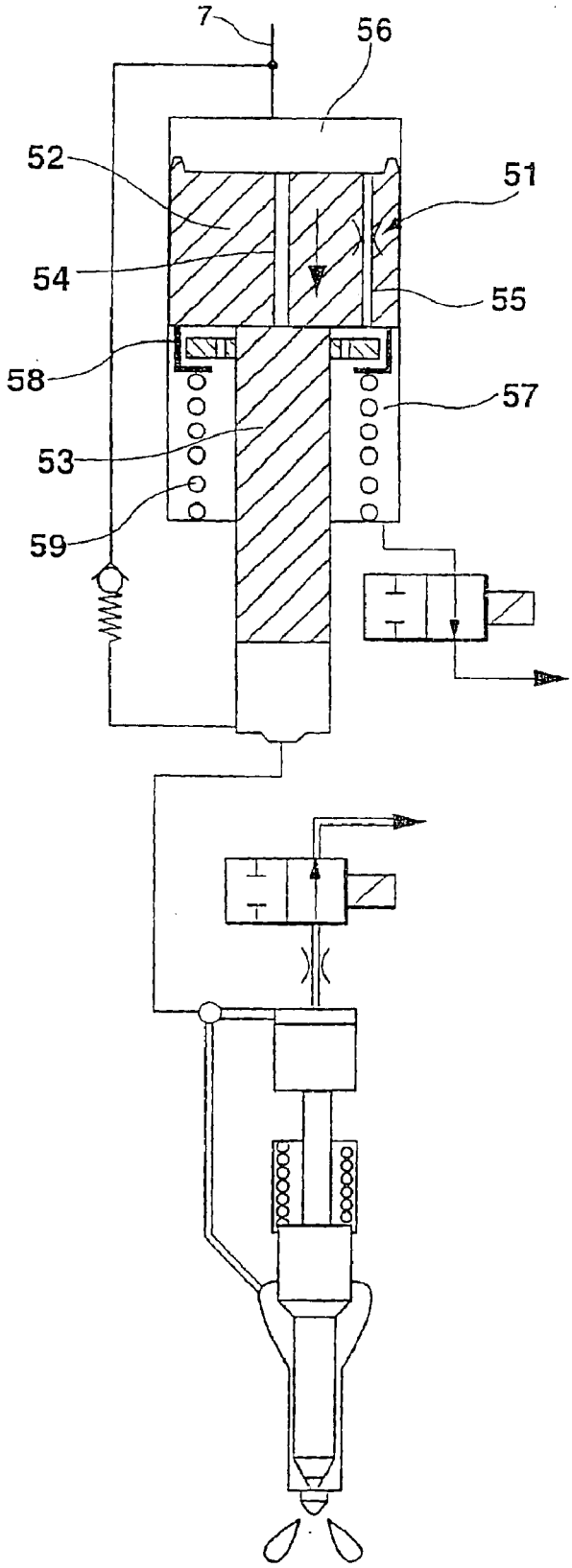
FIG. 3, a third pressure booster of a fuel injection system.

A fuel injection system of FIG. 3 includes a pressure booster or pressure booster 51, with a first piston 52 and a second piston 53. The first piston 51 has a first control conduit 54 and a second control conduit 55 with a throttle. The two pistons 52 and 53 are disposed movably relative to one another such that upon the restoration, a gap is created, which uncovers an additional connection between the pressure booster chamber 56 on the low-pressure side and differential chamber 57 through the conduit 54. The relative motion of the pistons 52 and 53 is limited by a stop (connecting means 58) and a spring 59. During the pumping stroke, the pistons 52 and 53 rest on one another, as shown in FIG. 3, and thus close the additional control conduit 54. The opening and closure of the gap are controlled by the piston stroke of the pistons 52 and 53—in a similar manner to what is shown in FIG. 1 and described in conjunction with it.

Figure 5:
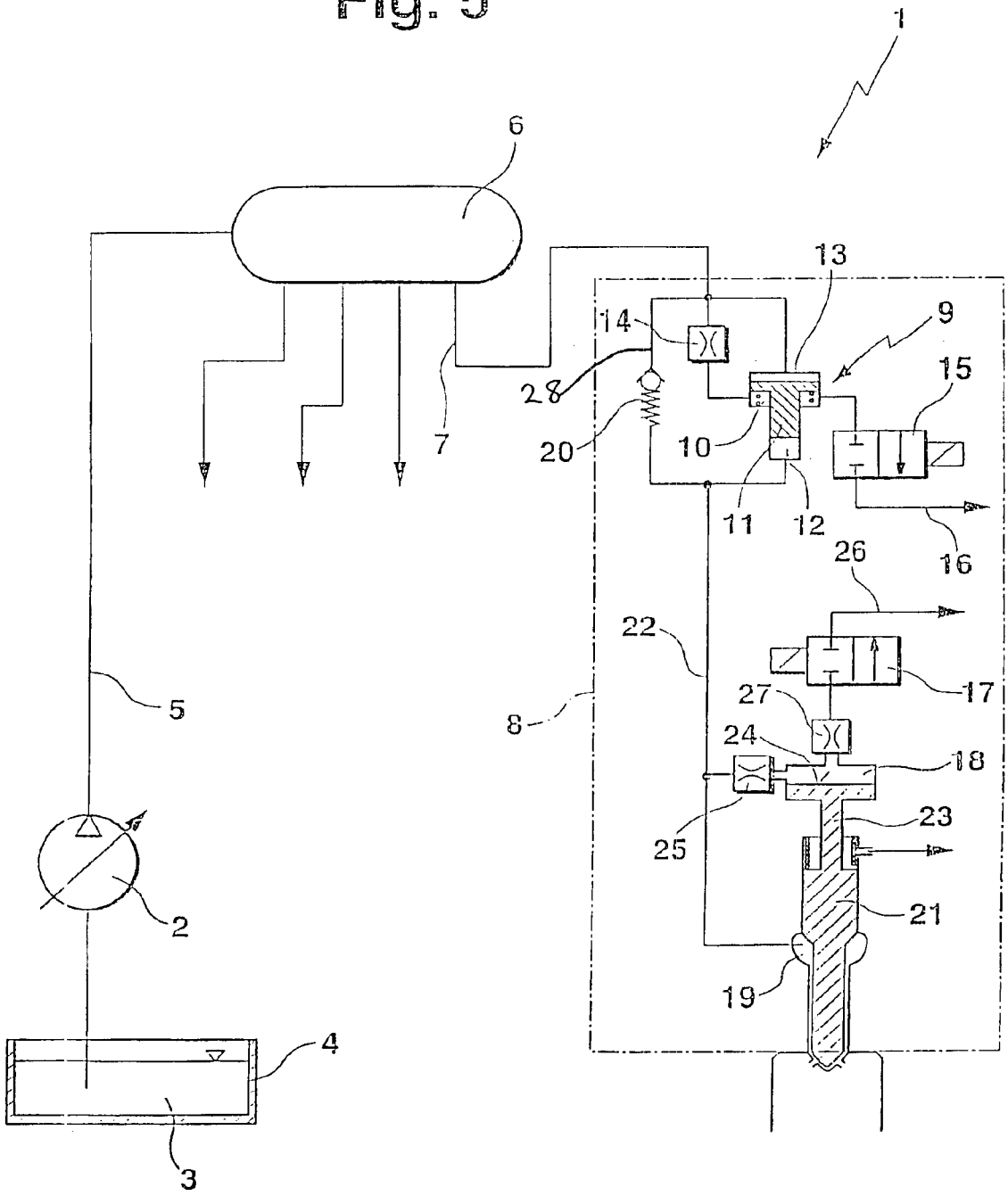
FIG. 5, a fuel injection system of the prior art.

In FIG. 4, a pressure booster 61 of an exemplary embodiment in a refinement of the prior art shown in FIG. 5 is shown. In this exemplary embodiment, a first control conduit 62 with a first throttle 63 and a second control conduit 64 with a second throttle 65 are embodied in a piston 66 of the pressure booster 61. The second control conduit 64 permanently connects the control chamber 67 on the low-pressure side with a differential chamber 68. The first control conduit 62 establishes a communication between the chambers 67 and 68 that is dependent on the piston stroke. After a piston stroke h, the communication is opened. Upon restoration, after a long piston stroke (>h) is effected, the restoring force is facilitated by the control conduits 62 and 64. In a short piston stroke (<h), the control conduit 64 suffices, so that leakage losses can be kept within limits.

In the prior art stroke-controlled fuel injection system 1 shown in FIG. 5, a quantity-regulated fuel pump 2 pumps fuel 3 from a tank 4 via a feed line 5 into a central pressure reservoir 6 (common rail), from which a plurality of pressure lines 7, corresponding in number to the number of individual cylinders, lead away to the individual injectors 8 (injection devices) protruding into the combustion chamber of the engine to be supplied. In FIG. 5, only one of the injectors 8 is shown. With the aid of the fuel pump 2, a first system pressure is generated and stored in the pressure reservoir 6. This first system pressure is used for the preinjection and as needed for postinjection (hydrocarbon enrichment for exhaust gas posttreatment or soot reduction) and also to produce an injection course with a plateau (boot injection). To injection fuel at a second, higher system pressure, each injector 8 is assigned a respective local pressure booster 9, which is located inside an injector 8.

In operation of the pressure booster 9, the pressure in the differential chamber 10, which is embodied by a transition from a larger to a smaller piston cross section, is used. For refilling and deactivating the pressure booster 9, the differential chamber 10 is acted upon by a supply pressure (rail pressure). Then the same pressure conditions (rail pressure) prevail at all the pressure faces of a piston 11. The piston 11 is pressure-balanced. By means of an additional spring, the piston 11 is pressed into its outset position. For activation of the pressure booster 9, the differential chamber 10 is pressure-relieved, and the pressure booster generates a pressure boost in accordance with the surface-area ratio. By means of this type of control, it is attainable that to restore the pressure booster 9 and refill a pressure booster chamber 12 on the high-pressure side, a pressure booster chamber 13 on the low-pressure side need not be pressure-relieved. Upon a small hydraulic boost, the depressurization losses can thus be sharply reduced.

For controlling the pressure booster 9, a throttle 14 and a 2/2-way valve 15 are employed. The throttle 14 connects the differential chamber 10 to fuel at supply pressure from a pressure reservoir 6. The 2/2-way valve 15 connects the differential chamber 10 to a leak fuel line 16. If the 2/2-way valves 15 and 17 are closed, then the injector 8 is at the pressure of the pressure reservoir 6. The pressure booster 9 is in its outset position. An injection at rail pressure can now be controlled by means of the valve 17. If an injection at higher pressure is wanted, then the 2/2-way valve 15 is triggered (opened), and a pressure boost is thus achieved. The piston 11 can be moved in the compression direction, so that the fuel located in the pressure booster chamber 12 is compressed and delivered to a control chamber 18 and a nozzle chamber 19. A check valve 20 prevents the reverse flow of compressed fuel into the pressure reservoir 6.

The injection is effected via fuel metering, with the aid of a nozzle needle 21, which is axially displaceable in a guide bore and has a conical valve sealing face on one end, with which it cooperates with a valve seat face on the injector housing of the injector 8. On the valve seat face of the injector housing, injection openings are provided. Inside the nozzle chamber 19, a pressure face pointing in the opening direction of the nozzle needle 21 is exposed to the pressure prevailing there, which is delivered to the nozzle chamber 19 via a pressure line 22. Also engaging the nozzle needle 21 coaxially to a valve spring is a pressure piece 23, which with its face end 24 remote from the valve sealing face defines the control chamber 18. The control chamber 18 has an inlet, from the direction of the fuel pressure connection, with a first throttle 25 and also has an outlet to a pressure relief line 26 with a second throttle 27, which is controlled by the 2/2-way valve 17.

The nozzle chamber 19 is continued, via an annular gap between the nozzle needle 21 and the guide bore, as far as the valve seat face of the injector housing. Via the pressure in the control chamber 18, the pressure piece 22 is subjected to pressure in the closing direction.

Fuel at the first or second system pressure constantly fills the nozzle chamber 19 and the control chamber 18. Upon actuation (opening) of the 2/2-way valve 17, the pressure in the control chamber 18 can be reduced, so that as a consequence, the pressure force-in the nozzle chamber 19 acting in the opening direction on the nozzle needle 21 exceeds the pressure force acting in the closing direction on the nozzle needle 21. The valve sealing face lifts from the valve seat face, and fuel is injected. The operation of pressure relief of the control chamber 19 and thus the stroke control of the valve member 17 can be varied by way of the dimensioning of the throttle 25 and the throttle 27.

The end of the injection is initiated by reactuation (closure) of the 2/2-way valve 17, which disconnects the control chamber 18 from the leak fuel line 26 again, so that in the control chamber 18, a pressure again builds up that can move the pressure piece 23 in the closing direction.

The bypass line 28 connected to the pressure reservoir 6 is also provided. The bypass line 28 communicates directly with the pressure line 22. The bypass line 28 can be employed for an injection at rail pressure and is disposed parallel to the pressure booster chamber 12, so that the bypass line 28 is passable, regardless of the motion and position of the piston 11.

The foregoing relates to preferred exemplary embodiments of the invention, it being understood that other variants and embodiments thereof are possible within the spirit and scope of the invention, the latter being defined by the appended claims.

What is claimed is:

1. A pressure booster (9*a*; 9*b*; 51; 61) of a fuel injection system (1), comprising a pressure booster chamber having a low pressure side (13; 67), a high pressure side (12) and a differential chamber (10*a*, 10*b*, 57; 68)

a displaceable piston unit (30*a*, 31*a*; 30*b*, 31*b*; 52, 53; 66), disposed in the pressure booster chamber and having a first cross section on one end which can be subjected to pressure via the low pressure side (13; 68) of the pressure booster chamber and a second cross section on its other end subjected to pressure in the high pressure side (12) of the pressure booster chamber for fuel compression, the piston unit (30*a*, 31*a*; 30*b*, 31*b*; 52, 53; 66) having a third piston cross section, which is reduced compared to the first piston cross section, disposed in the differential chamber (10*a*; 10*b*; 57; 68), the differential chamber being connectable to a leak fuel line (16), and at least one control conduit (33, 35; 54, 55; 62, 64) connecting the pressure booster chamber (13; 67) on the low-pressure side to the differential chamber (10*a*; 10*b*; 57; 68), the at least one control conduit having an opening that is closed or opened as a function of the motion of at least parts of the piston unit (30*a*, 31*a*; 31*a*, 31*b*; 52, 53; 66), the pressure booster chamber (13; 67) on the low-pressure side, the pressure booster chamber on the high-pressure side, and the differential chamber (10*a*; 10*b*; 57; 68), when the pressure booster (9*a*; 9*b*; 51; 61) is not activated, are filled with fuel that is at system pressure.

2. The pressure booster of claim 1, wherein the at least one control conduit (33, 35; 54, 55; 62, 64) is integrated with the piston unit (30*a*, 31*a*; 31*a*, 31*b*; 52, 53; 66).

3. The pressure booster of claim 1, wherein the at least one control conduit (33, 35; 54, 55; 62, 64) includes a throttle (34, 36; 63, 65).

4. The pressure booster of claim 2, wherein the at least one control conduit (33, 35; 54, 55; 62, 64) includes a throttle (34, 36; 63, 65).

5. The pressure booster of claim 1, wherein the piston unit comprises of at least two pistons, and connecting means (37*a*; 37*b*; 59) embodied such that the pistons (30*a*, 31*a*; 30*b*, 31*b*; 52, 53), between the pumping stroke of the pressure booster (9*a*; 9*b*; 51) and the restoring motion of the pressure booster (9*a*; 9*b*; 51) execute a relative motion relative to one another, and as a result of this relative motion, the at least one control conduit (35; 54) is opened and closed.

6. The pressure booster of claim 2, wherein the piston unit comprises of at least two pistons, and connecting means (37*a*; 37*b*; 59) embodied such that the pistons (30*a*, 31*a*; 30*b*, 31*b*; 52, 53), between the pumping stroke of the pressure booster (9*a*; 9*b*; 51) and the restoring motion of the pressure booster (9*a*; 9*b*; 51) execute a relative motion relative to one another, and as a result of this relative motion, the at least one control conduit (35; 54) is opened and closed.

7. The pressure booster of claim 3, wherein the piston unit comprises of at least two pistons, and connecting means (37*a*; 37*b*; 59) embodied such that the pistons (30*a*, 31*a*; 30*b*, 31*b*; 52, 53), between the pumping stroke of the pressure booster (9*a*; 9*b*; 51) and the restoring motion of the pressure booster (9*a*; 9*b*; 51) execute a relative motion relative to one another, and as a result of this relative motion, the at least one control conduit (35; 54) is opened and closed.

8. The pressure booster of claim 4, wherein the piston unit comprises of at least two pistons, and connecting means (37*a*; 37*b*; 59) embodied such that the pistons (30*a*, 31*a*; 30*b*, 31*b*; 52, 53), between the pumping stroke of the pressure booster (9*a*; 9*b*; 51) and the restoring motion of the pressure booster (9*a*; 9*b*; 51) execute a relative motion relative to one another, and as a result of this relative motion, the at least one control conduit (35; 54) is opened and closed.

9. The pressure booster of claim 5, wherein the opening of the at least one control conduit (35; 55) is disposed in a gap (38*a*; 38*b*) between a first piston (30*a*; 30*b*; 52) and a second piston (31*a*; 31*b*; 53) and is controlled via a spring (37*a*; 37*b*) in such a way that the opening is closed upon activation of the pressure booster (9*a*; 9*b*; 51) and is opened by the relative motion of the pistons (30*a*, 31*a*; 30*b*, 31*b*; 52, 53) to one another with the pressure booster (9*a*; 9*b*; 51) switched off.

10. The pressure booster of claim 6, wherein the opening of the at least one control conduit (35; 55) is disposed in a gap (38*a*; 38*b*) between a first piston (30*a*; 30*b*; 52) and a second piston (31*a*; 31*b*; 53) and is controlled via a spring (37*a*; 37*b*) in such a way that the opening is closed upon activation of the pressure booster (9*a*; 9*b*; 51) and is opened by the relative motion of the pistons (30*a*, 31*a*; 30*b*, 31*b*; 52, 53) to one another with the pressure booster (9*a*; 9*b*; 51) switched off.

11. The pressure booster of claim 7, wherein the opening of the at least one control conduit (35; 55) is disposed in a gap (38*a*; 38*b*) between a first piston (30*a*; 30*b*; 52) and a second piston (31*a*; 31*b*; 53) and is controlled via a spring (37*a*; 37*b*) in such a way that the opening is closed upon activation of the pressure booster (9*a*; 9*b*; 51) and is opened by the relative motion of the pistons (30*a*, 31*a*; 30*b*, 31*b*; 52, 53) to one another with the pressure booster (9*a*; 9*b*; 51) switched off.

12. The pressure booster of claim 8, wherein the opening of the at least one control conduit (35; 55) is disposed in a gap (38*a*; 38*b*) between a first piston (30*a*; 30*b*; 52) and a second piston (31*a*; 31*b*; 53) and is controlled via a spring (37*a*; 37*b*) in such a way that the opening is closed upon activation of the pressure booster (9*a*; 9*b*; 51) and is opened by the relative motion of the pistons (30*a*, 31*a*; 30*b*, 31*b*; 52, 53) to one another with the pressure booster (9*a*; 9*b*; 51) switched off.

13. The pressure booster of claim 1, wherein the opening is opened upon a pumping stroke>h that is executed by a one-piece piston unit (66).

14. The pressure booster of claim 2, wherein the opening is opened upon a pumping stroke>h that is executed by a one-piece piston unit (66).

15. The pressure booster of claim 3, wherein the opening is opened upon a pumping stroke>h that is executed by a one-piece piston unit (66).

* * * * *